US007503628B2

(12) United States Patent
Hall et al.

(10) Patent No.: US 7,503,628 B2
(45) Date of Patent: Mar. 17, 2009

(54) FORMATION BREAKING ASSEMBLY

(76) Inventors: David R. Hall, 2185 S. Larsen Pkwy., Provo, UT (US) 84606; Ronald Crockett, 2185 S. Larsen Pkwy., Provo, UT (US) 84606; Robert P. Chase, 2185 S. Larsen Pkwy., Provo, UT (US) 84606

( * ) Notice: Subject to any disclaimer, the term of this patent is extended or adjusted under 35 U.S.C. 154(b) by 379 days.

(21) Appl. No.: 11/469,569

(22) Filed: Sep. 1, 2006

(65) Prior Publication Data

US 2008/0054707 A1 Mar. 6, 2008

(51) Int. Cl.
*E21C 3/00* (2006.01)

(52) U.S. Cl. ..... 299/100; 299/70

(58) Field of Classification Search ..... 299/100, 299/105, 69, 70, 79.1
See application file for complete search history.

(56) References Cited

U.S. PATENT DOCUMENTS 2,817,316 A * 12/1957 Gosta ..... 279/19.1
3,807,804 A * 4/1974 Kniff ..... 299/113
3,981,540 A 9/1976 Hawkes
4,005,906 A * 2/1977 McKenry et al. ..... 299/105
4,042,036 A 8/1977 Smith
4,062,411 A 12/1977 Adkins
4,131,165 A 12/1978 Wanner
4,227,744 A 10/1980 Livesay
4,237,987 A 12/1980 Sherman
4,470,440 A 9/1984 Thor
4,562,974 A 1/1986 Bezette
4,646,852 A 3/1987 Cotta
4,666,213 A 5/1987 Howard
4,682,412 A 7/1987 Pfeffer
4,759,412 A 7/1988 Brazell
4,838,363 A 6/1989 MacOnochie
4,858,701 A 8/1989 Weyer
4,944,559 A * 7/1990 Sionnet et al. ..... 299/105
5,183,316 A * 2/1993 Ottestad ..... 299/69
5,388,842 A 2/1995 Piras
5,944,117 A 8/1999 Burkholder
5,992,538 A 11/1999 Marcengill
6,257,352 B1 7/2001 Nelson
6,857,482 B2 2/2005 Commarmond

* cited by examiner

*Primary Examiner*—John Kreck
(74) *Attorney, Agent, or Firm*—Tyson J. Wilde

(57) ABSTRACT

A formation breaking apparatus with increased wear-resistance is disclosed. In one aspect of the invention, the apparatus has an assembly attached to an end of an articulated arm. The assembly has an actuator in mechanical communication with an axially guided penetrator. The penetrator may have a body intermediate a proximate end and a distal end; the proximate end being adapted to communicate with the actuator, and the distal end comprising a hard material with a hardness of at least 63 HRc.

17 Claims, 10 Drawing Sheets

FORMATION BREAKING ASSEMBLY

BACKGROUND OF THE INVENTION

Formation breaking assemblies, such as rock breakers, are often used to break hard materials such as rocks, cement, or other hard materials. These assemblies often comprise a steel shaft with an end adapted to contact the formation. These formation breaking assemblies are often mounted to a vehicle or are some times permanently installed in quarries where rocks are brought to the breaking assembly.

U.S. Pat. No. 5,944,117 to Burkholder et al., which is herein incorporated by reference for all that it contains, discloses an improved fluid actuated percussive impact tool of the valveless type adapted for down hole drilling. The impact tool includes a casing, a back head, a distributor located at a first end of the casing, and an impact receiving device located at a second end of the casing. A chamber is located between the distributor and the impact receiving device. A cylinder sleeve is located in the chamber adjacent to the distributor. A first pressurized fluid passage is located between the casing and the cylinder sleeve for passing pressurized fluid from the distributor to the chamber. A piston is located in the chamber for reciprocating axial movement. Axially extending ports are located on at least one of the piston, the cylinder sleeve and the casing in the chamber for alternately supplying pressurized fluid to upper and lower chamber portions. An exhaust bore is provided in fluid communication with the chamber which selectively exhausts pressurized fluid from the upper and lower chamber portions to thereby reciprocate the piston between a first position wherein the first end of the piston is in contact with the impact receiving device and a second position wherein the second end is in proximity to the distributor to impart blows on the impact receiving device. The piston has an elongated generally cylindrical body and a reduced diameter neck forming a first lifting surface which is offset a first distance from the first end of the piston. A first axially extending port is located on the piston between the first and second sealing surfaces. The intersection of the first sealing surface and the first axially extending port defines a port opening timing location located a second distance from the first end of the piston. The first distance on the impact receiving device is at least 40% of second distance such that the frequency of blows per minute is increased by at least 10 percent.

U.S. Pat. No. 6,857,482 to Comarmond, which is herein incorporated by reference for all that it contains, discloses an apparatus comprising a body wherein a piston is mounted sliding alternately driven by an incompressible fluid under pressure, said body containing part of a tool which is guided in translation in a wear sleeve, the end of the tool located inside the body being subjected to the repeated impacts of the piston, while the other end projects beyond the body and is designed to be supported on the rock or analogue to be destroyed, the tool being retained in the body by at least a transverse key. One of the keys retaining the tool passes through aligned holes provided in the body, into the wear sleeve, and overlaps inside the inner cylindrical space of the sleeve, the tool having a transverse groove for the key to pass through.

U.S. Pat. No. 4,759,412 to Brazell, II, which is herein incorporated by reference for all that it contains, discloses a rock breaking device adapted to be coupled to the lifting arms of a tractor or similar vehicle is disclosed, the device having an upstanding guide tube with a hammer, chisel, and anvil disposed therein. The hammer can be raised within the guide tube by frictional engagement with a drive member and is then allowed to fall by gravitational force to impact the chisel and/or the chisel and anvil, thereby driving the chisel into the surface to be broken. The device has a shock absorber to minimize the force of impact and as a safety feature, cannot be made operational until actually positioned on the surface to be broken.

U.S. Pat. No. 4,470,440 to Thor, which is herein incorporated by reference for that it contains, discloses an impact producing tool that has a longitudinal axis with an impacting working head member rigidly connected to the end of a housing. An elongated handle is floatingly connected to and extends from the impacting head member and out of an opening disposed an end cap portion at the other end of the housing. A positioning member is located on the impacting head member and has a structural configuration effective to maintain the elongated handle at a predetermined position with respect to the impacting working head member. A hammer element is movably disposed on the elongated handle and is effective to apply a striking force on the impact receiving end of the housing. The impacting working head member has a structural configuration effective to act on a workpiece or work surface when the striking force is applied to the impact receiving end of the housing. The floating connection between the elongated handle and the housing overcomes a basic problem of structural deficiencies associated with handles rigidly connected to a housing element. A particular feature of the invention is the interchangeability of working head members which accomplish various functions with respect to the impact producing tool.

BRIEF SUMMARY OF THE INVENTION

A formation breaking apparatus with increased wear-resistance is disclosed. In one aspect of the invention, the apparatus comprises an assembly attached to an end of an articulated arm. The assembly comprises an actuator in mechanical communication with an axially guided penetrator. The penetrator may comprise a body intermediate a proximate end and a distal end; the proximate end being adapted to mechanically communicate with the actuator, and the distal end comprising a hard material with a hardness of at least 63 HRc. In this disclosure, the abbreviation "HRc" stands for the Rockwell "C" scale, and the abbreviation "HV" stands for Vickers hardness.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following more detailed description of embodiments of the methods of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
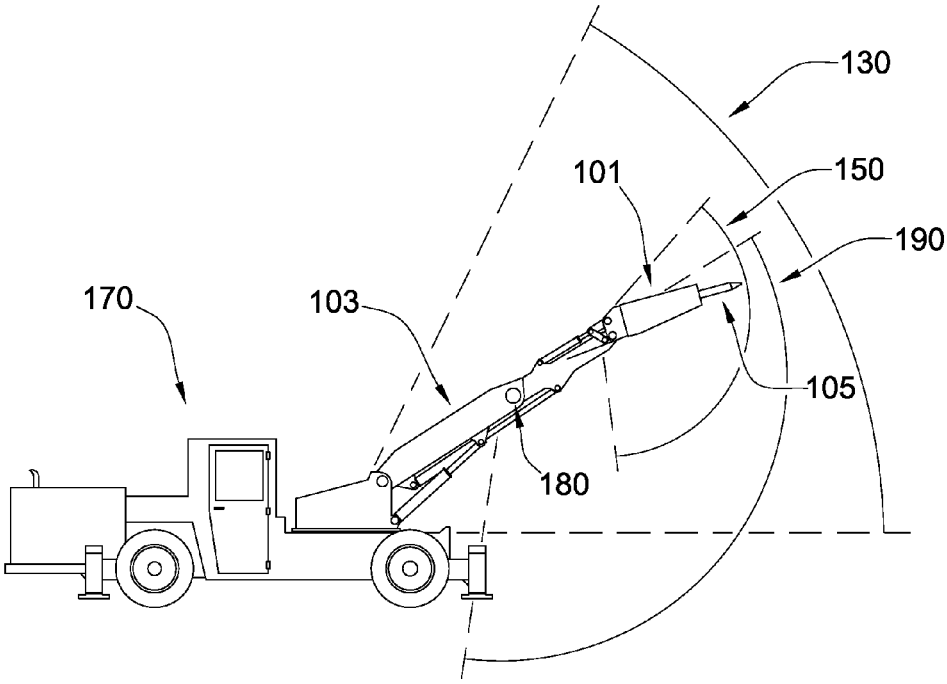
FIG. 1 is a side perspective diagram of an embodiment of a formation breaking assembly.
Figure 2:
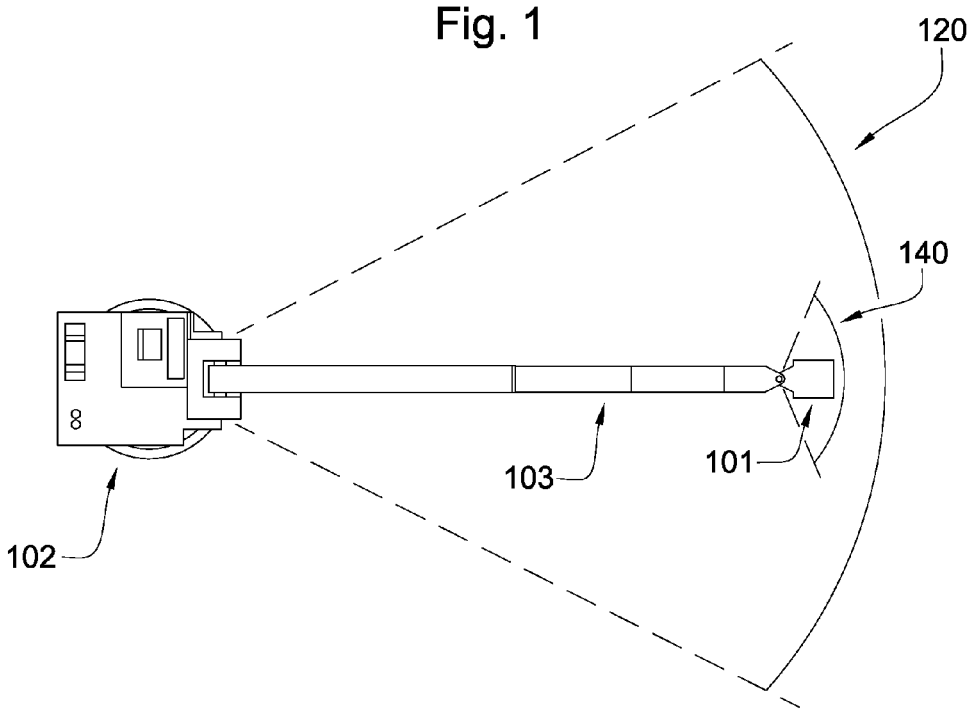
FIG. 2 is a top perspective diagram of an embodiment of a formation breaking assembly.

FIG. 1 is an orthogonal diagram of a formation breaking assembly 101 which may be attached to an articulated arm 103 attached to a vehicle 170. A formation breaking assembly 101 may comprise an actuator in mechanical communication with an axially guided penetrator 105. In the embodiment of FIG. 1 a swivel assembly 102 is adapted to connect the arm 103 to the vehicle 170. The swivel assembly 102 may allow the arm to rotate within a desire swing arc 120 as shown in FIG. 2. The articulated arm 103 may comprise at least one joint that allows the arm 103 to position the breaking assembly 101 at various heights and/or various angles. In the preferred embodiment, the articulated arm 103 comprises at least two joints. Each joint is adapted to hydraulic move the arm within a desired tilt arc.

A vehicle 170 may be a backhoe, a skid loader, an excavator, a front loader, or the like. With each of these vehicles 170 the assembly 101 may be removably attached to an arm 103 connected to the vehicle 170, or permanently attached. Tubes (not shown) may extend down the arm 103 to provide pneumatic and/or hydraulic power to the assembly 101 and to power pistons 110 on the arm 103. The vehicle 170 may also comprise a pump and/or compressor used with the pneumatic or hydraulic system. The total length of the arm 103 may be 5 to 75 feet; preferably 20 to 45 feet.

The swing arc 120 may be 1 to 90 degrees. Tilt arcs 130, 150 or 190 may also be 1 to 90 degrees. In the preferred embodiment, the arm has a swing arc of 50-60 degrees and each tilt arc is about 45 to 75 degrees. The assembly 101 itself may have a swing arc 140 of 1 to 80 degrees and/or a tilt arc 150 of 1 to 145 degrees. The swing arc may be defined as the degree of pivotal movement substantially normal to the gravitational load on the arm while the tilt arc may be defined as the degree of pivotal movement substantially parallel with the gravitational load. In some embodiments, the apparatus may have a joint adapted to move diagonally, or said in other words a joint adapted to move in the normal and parallel directions at the same time.

In some embodiments, such as the embodiment of FIG. 2, the articulated arm 103 may be positioned adjacent a pit where rocks or other materials are brought to it. The breaker assembly, with the allowance of the articulated arm, may reach the materials at various desired angles for optimal size reduction.

Figure 3:
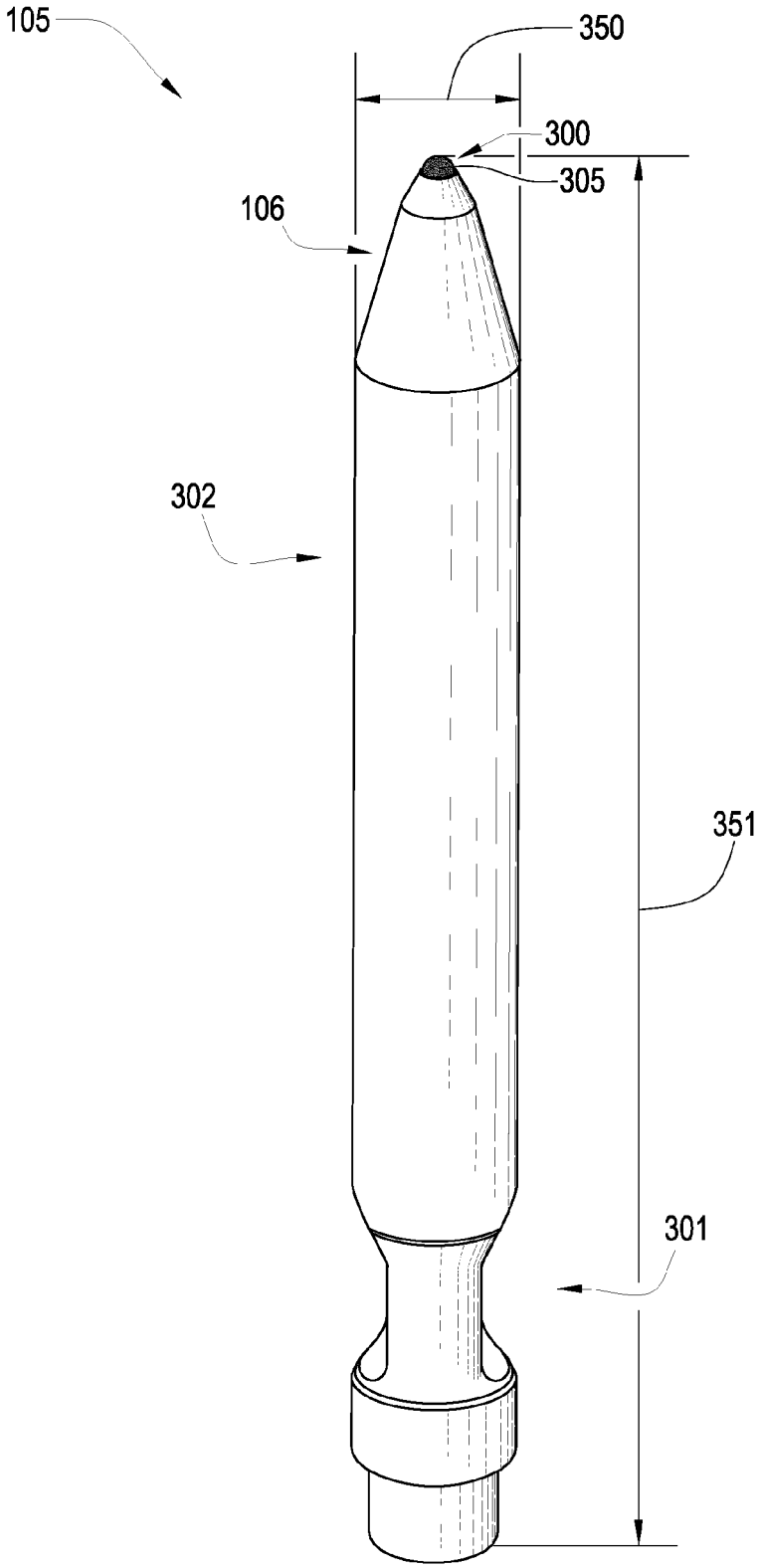
FIG. 3 is a perspective diagram of an embodiment of a penetrator.
Figure 5:
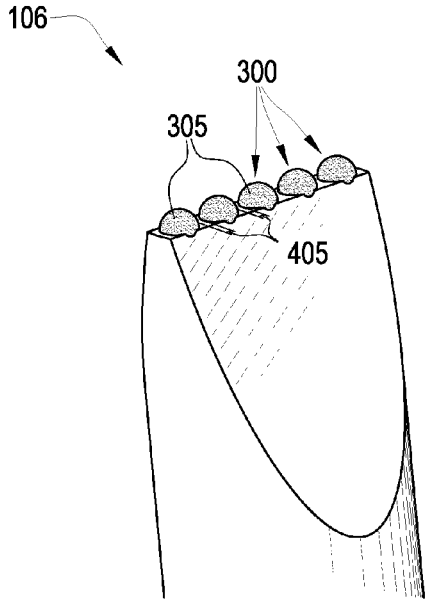
FIG. 5 is a perspective diagram of an embodiment of a distal end.

FIG. 3 is a perspective diagram of an embodiment of a penetrator 105. The penetrator 105 may comprise a body 302 intermediate a proximate end 301 and a distal end 106. The distal end 106 may comprise a hard material 300 with a hardness of at least 63 HRc. The hard material 300 may be a single insert 305 on the distal end 106. The distal end 106 may comprise various geometries including a moil geometry (as seen in FIG. 5), a chisel geometry, a conical geometry, a rounded geometry, a flat geometry, a pyramidal geometry, an asymmetric geometry, a semi-spherical geometry, or combinations thereof. In some embodiments, the proximate end is adapted to receive blows from a hammer, or be actuated by movement a piston or cam. Such movement transmits force to the distal end, which is adapted to engage the formation.

The penetrator 105 may comprise a diameter 350 of 1 to 15 inches. The penetrator's height 351 may be 5 to 60 inches. In some embodiments, the diameter may be 3.75 to 7 inches. The operating weight of the penetrator 105 may be from 1,000 to 10,500 pounds. The operating pressure of the penetrator 105 may be from 1,900 to 2,700 psi. In some embodiments of the present invention, the distal end of the penetrator may be replaceable.

Figure 4:
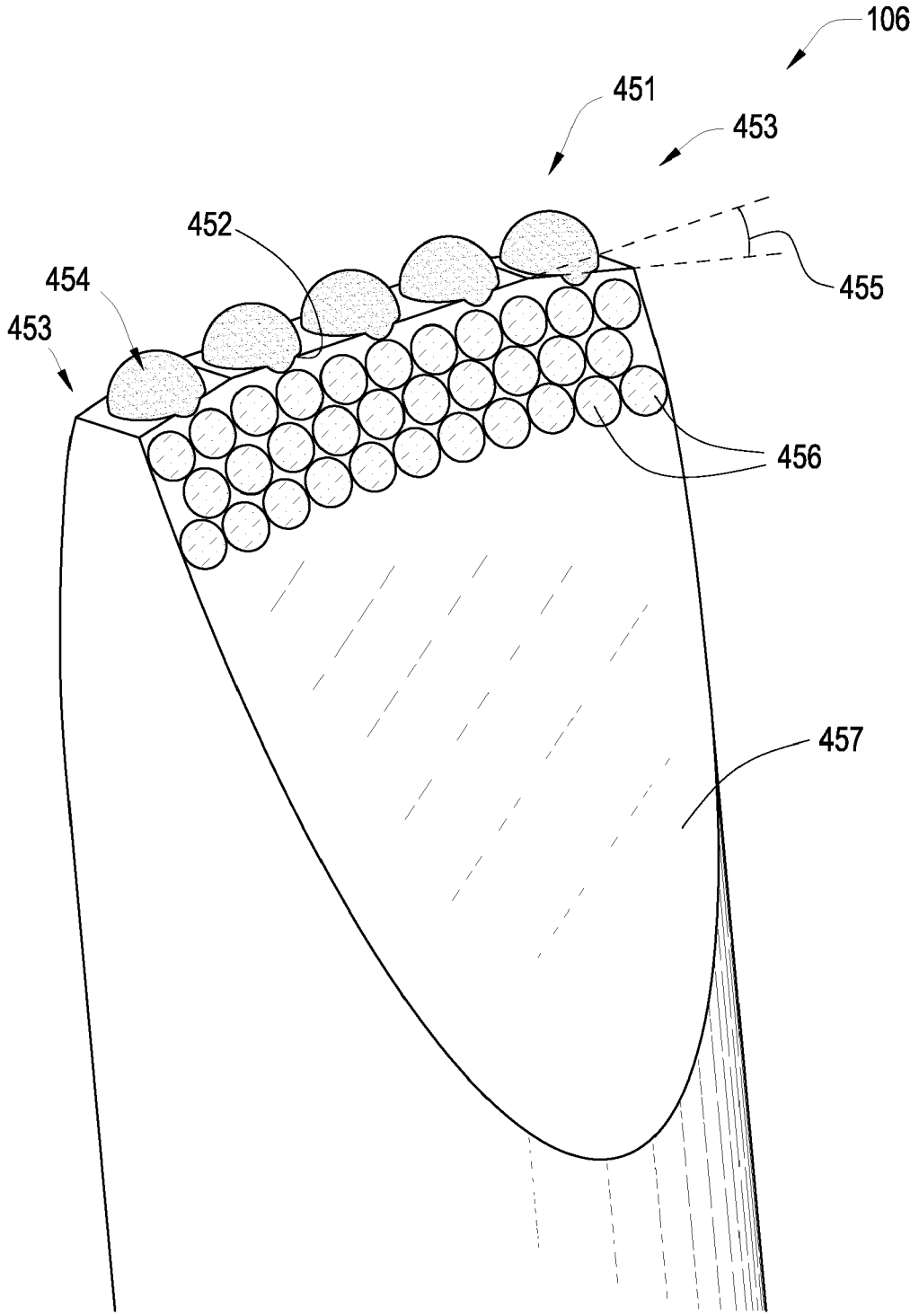
FIG. 4 is a perspective diagram of an embodiment of a distal end.

FIG. 4 is an embodiment of a distal end 106 with a chisel geometry 450. Inserts 451 comprising a substrate and a superhard coating are press fit or brazed into pockets 452 formed in a ridge 453 of the end 106. The outside inserts 454 are off set at a slight angle 455. The superhard coating is preferably made of a hard material such as polycrystalline diamond and the substrate is made of a tungsten carbide. Hard inserts 456, preferably tungsten carbide inserts are press fit into a tapered surface 457 leading to the ridge 453.

FIG. 5 is a perspective diagram of an embodiment of a distal end 106 comprising a chisel geometry. Inserts 305 comprising hard material may be distributed along the ridge 453 of the distal end 106. Gaps 405 between the insert may be protected from significant wear due to close spacing of the inserts.

Figure 6:
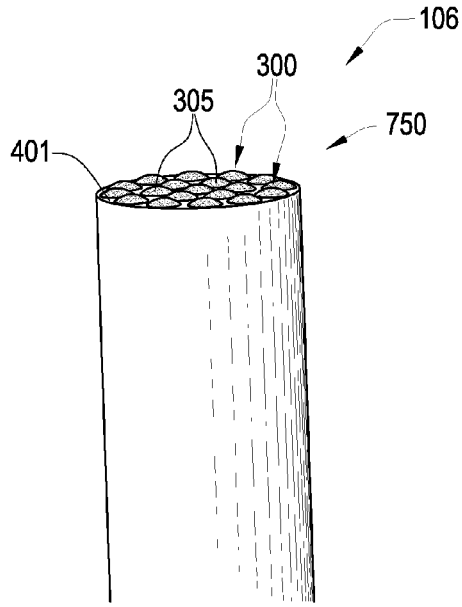
FIG. 6 is a perspective diagram of an embodiment of a distal end.

FIG. 6 is a perspective diagram of another embodiment of a distal end 106 comprising a flat geometry 750. Individual inserts 305 may be distributed across the flat surface 401 of the distal end 106, or a coating of a hard material 300 may cover the entire surface 401. The inserts of FIG. 6 comprise a blunter geometry than the inserts of FIG. 5. Different sharpness of the inserts may be optimal for different formations, depending on the formation elasticity, hardness, and abrasion.

Figure 7:
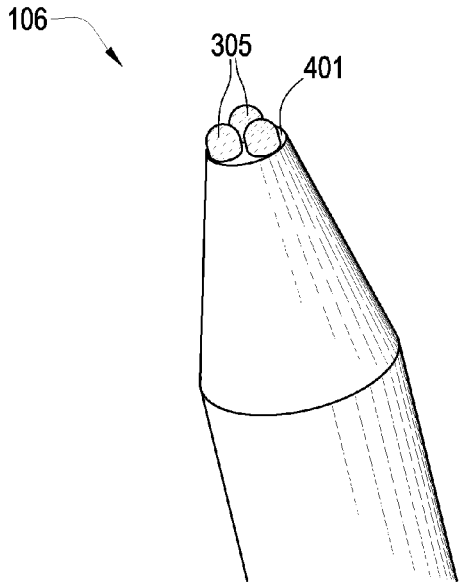
FIG. 7 is a perspective diagram of an embodiment of a distal end.
Figure 8:
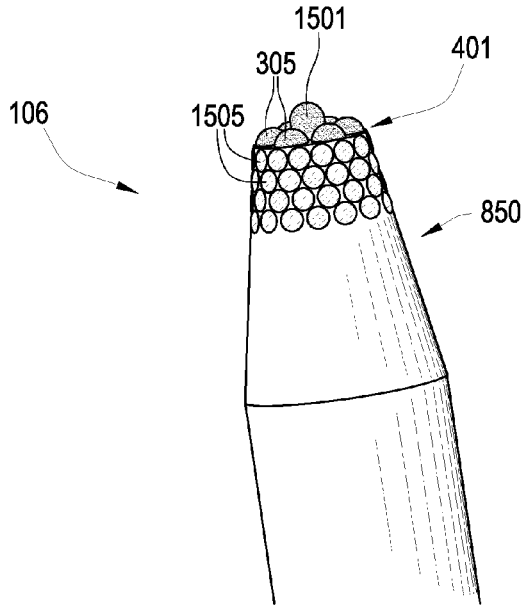
FIG. 8 is a perspective diagram of an embodiment of a distal end.
Figure 9:
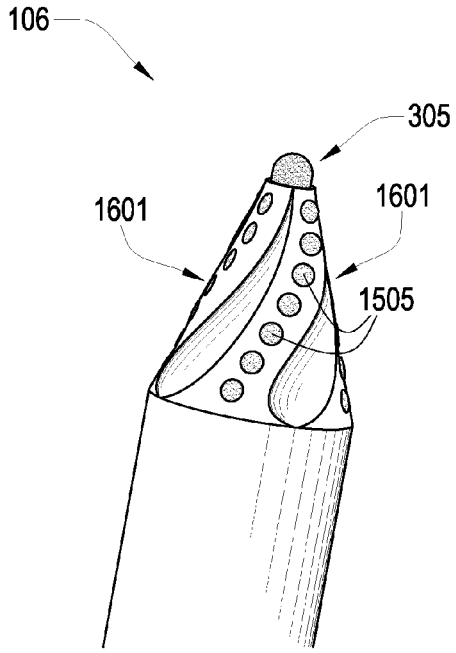
FIG. 9 is a perspective diagram of an embodiment of a distal end.

FIGS. 7-9 disclose distal ends comprising moil geometries. In the embodiment of FIG. 7, the end comprises a plurality of hard inserts 305 on the flat surface 401. The embodiment disclosed in FIG. 8 also comprises a plurality of inserts 305 press fit into the flat surface 401 of the distal end 106. A central insert 1501 protrudes beyond the other inserts 305. Side inserts 1505 are press fit into the tapered portion 850 of the moil geometry. In the embodiment of FIG. 9, flutes 1601 are formed in the tapered region 850, which may act as junk slots. In some embodiments, it may be desirable for the distal end of the breaker to rotate. In such embodiments, the flutes may aid the distal end in rotation upon impact.

Figure 10:
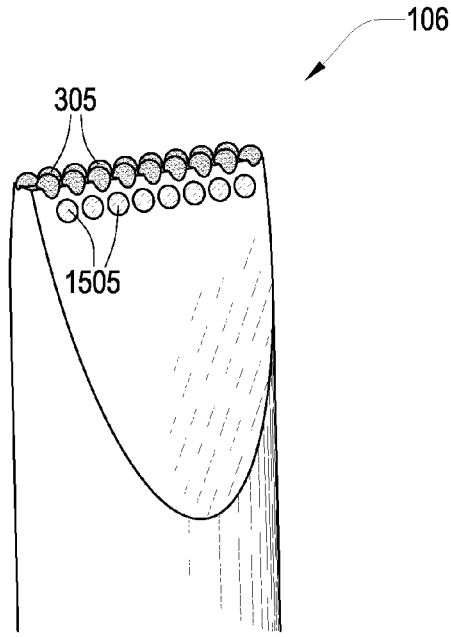
FIG. 10 is a perspective diagram of an embodiment of a distal end.
Figure 11:
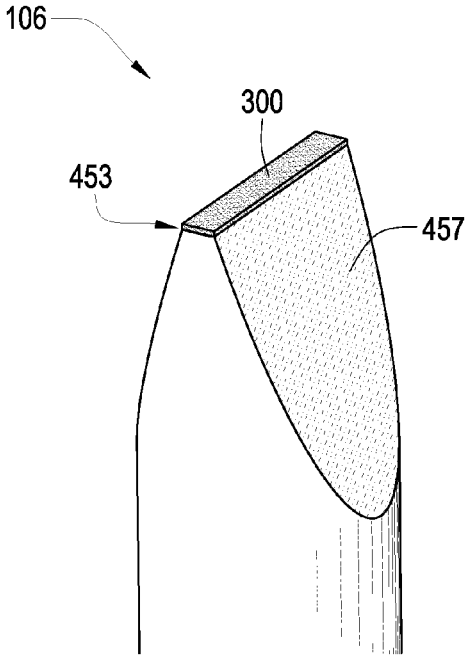
FIG. 11 is a perspective diagram of an embodiment of a distal end.
Figure 12:
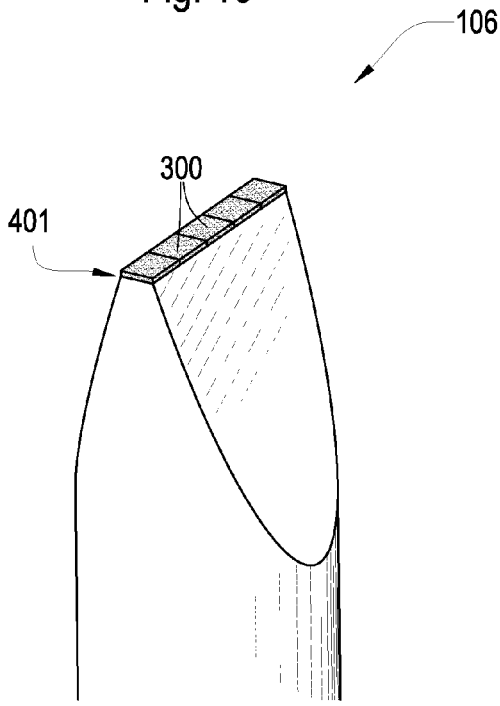
FIG. 12 is a perspective diagram of an embodiment of a distal end.

FIGS. 10-12 disclose several other embodiments with chisel geometries. The embodiment of FIG. 10 discloses at least two rows of inserts 305 attached to the ridge of the distal end 106 and other inserts 1505 attached to the tapered surface of the chisel geometry. Since the other inserts 1505 will typically not see the same forces as the inserts 305 attached to the ridge, the other inserts 1505 may be made a softer material but are preferably still made of a material harder than 63 HRc. In the embodiment of FIG. 10, inserts 305 have a diamond coating whereas inserts 1505 are made of a cemented metal carbide. FIG. 11 disclosed layer of diamond attached to the ridge and a layer of carbide attached to the tapered surface. The diamond layer may be segmented as it is shown in FIG. 12. Layers of hard materials may be brazed to their respective surfaces or they may be deposited in place. Thermal spraying, cladding, electroless plating, electro-plating, chemical vapor deposition, hot-dipping, hard facing, or physical vapor deposition may be used to attach the hard material to the penetrator.

Figure 13:
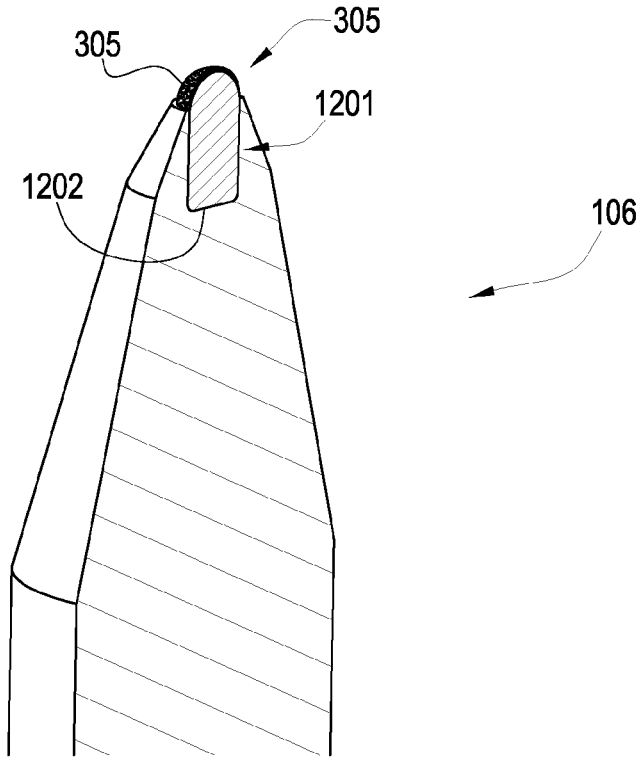
FIG. 13 is a perspective diagram of an embodiment of a distal end.

FIG. 13 is a cross-sectional perspective diagram of an embodiment of a distal end 106. A pocket 1201 may be created in the distal end 106 to receive an insert 305. The segment 305 may be chemically and/or mechanically bonded to the distal end 106 at an interface 1202. Chemical bonding may be performed by means of brazing. The hard material and/or the substrate (intermediate material) may be bonded to the distal end 106 by means of a braze material (not shown) selected from the group comprising silver, gold, copper, nickel, palladium, boron, chromium, silicon, germanium, aluminum, iron, cobalt, manganese, titanium, tin, gallium, vanadium, indium, phosphorus, molybdenum, platinum, or combinations thereof. If the segment 300 is mechanically bonded to the distal end 106, it may be press fit into the pocket 1201.

If brazed, the intermediate material 601 may be brazed into a pocket 1201 or a surface of the distal end using a braze material comprising 30 to 62 weight percent of palladium. The braze material may further comprise 30 to 60 weight percent nickel and 3 to 15 weight percent silicon. Preferably, the braze material may comprise 47.2 weight percent nickel, 46.7 weight percent palladium, and 6.1 weight percent silicon. The braze material may comprise a melting temperature of 700 to 1100 degrees Celsius; preferably the melting temperature is from 800 to 970 degrees Celsius. Further, another braze material may also be used that comprises 40 to 80 weight percent copper, 3 to 20 weight percent nickel, and 3 to 45 weight percent manganese; preferably the material may comprise 67.5 weight percent copper, 9 weight percent nickel, and 23.5 weight percent manganese. Such a braze material may comprise a melting temperature of 800 to 1200 degrees Celsius.

Figure 14:
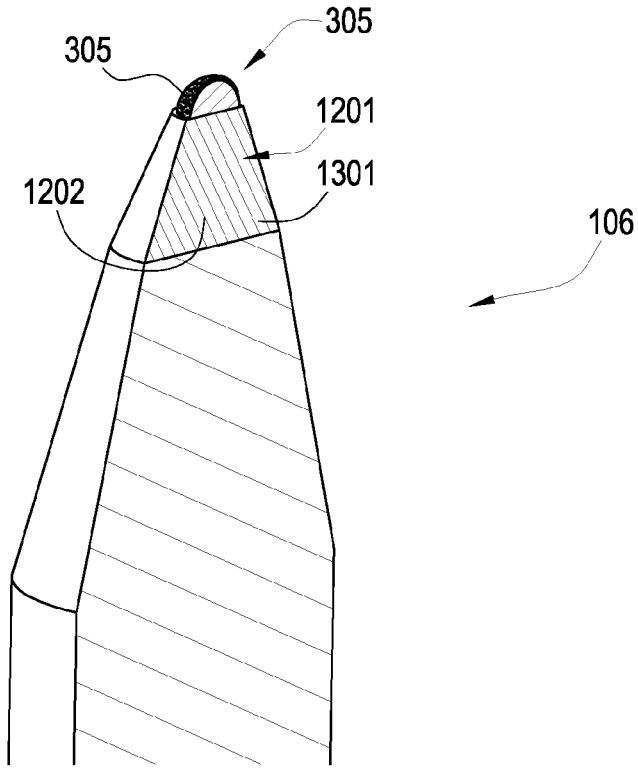
FIG. 14 is a perspective diagram of an embodiment of a distal end.

FIG. 14 is a cross-sectional perspective diagram of another embodiment of a distal end 106. A bolster, as shown in the embodiment of FIG. 14, may be made of tungsten carbide and the insert 305 may comprise a layer of polycrystalline diamond. Adding a bolster 1301 may increase the penetrator's wear-resistance. The bolster 1301 may be brazed to the distal end 106 or the body 302 by means disclosed above. The insert may be brazed to a flat end of the bolster or it may be brazed within a pocket of the bolster.

Figure 15:
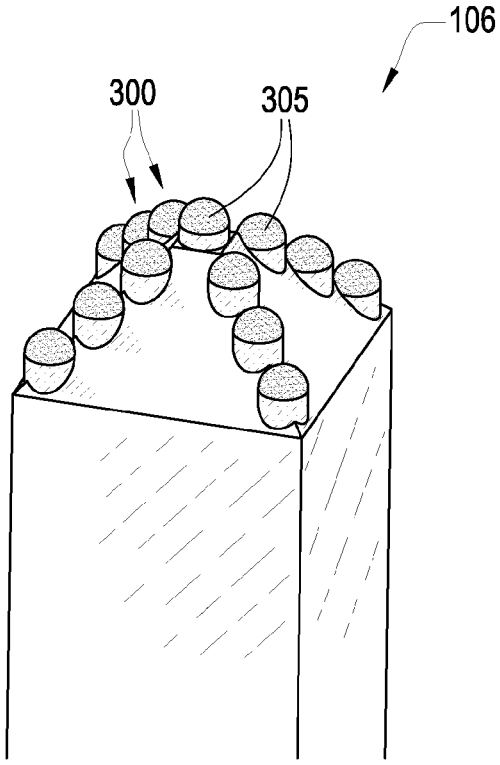
FIG. 15 is a perspective diagram of an embodiment of a distal end.

FIG. 15 is a perspective diagram of another embodiment of a distal end 106. The distal end 106 may comprise a generally pyramidal shaped. The distal end 106 may comprise inserts 305, or be covered with a uniform layer of hard material 305

Figure 16:
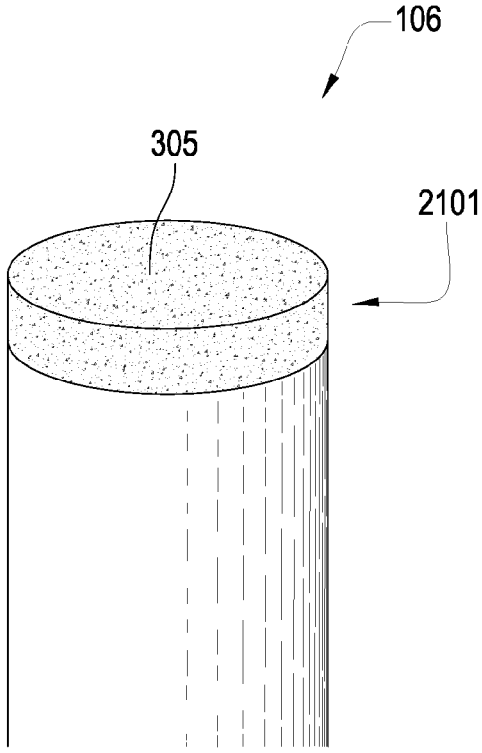
FIG. 16 is a perspective diagram of an embodiment of a distal end.
Figure 17:
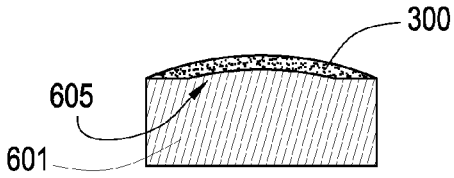
FIG. 17 is a cross-sectional diagram of an embodiment of a hard material bonded to an intermediate material.

FIG. 16 is a perspective diagram of another embodiment of a distal end 106. The hard material 305 may comprise a layer 2101 of a diamond-impregnated material bonded to the distal end 106. The material may be matrix, tungsten carbide, or other suitable material for holding diamonds. In other embodiments, other hard materials may be impregnated such as cubic boron nitride or other ceramics. As the penetrator 105 impacts the formation the supporting material may wear away exposing new diamonds. The diamonds may increase the distal end's wear-resistance and the distal end 106 may be self-sharpening because new diamonds will be continuously exposed.

In any of the embodiments thus disclosed the inserts may protrude out of the distal end or they may be flush with the surface 401 of the distal end 106. In some embodiments, it may be desirable to have the side segments 1505 comprise a slight convex surface and protrude slightly out from the surface.

FIGS. 17 through 22 are cross-sectional diagrams of embodiments of a hard material 305 bonded to substrates or intermediate material 601. The hard material may be a composite. The hard material may have a hardness of 63 HRc, preferably a hardness of 2,000 HV, and more preferably a hardness of 4,000 HV. The hard material 305 may comprise chromium, tungsten, tantalum, niobium, titanium, molybdenum, carbide, natural diamond, polycrystalline diamond, vapor deposited diamond, layered diamond, infiltrated diamond, cubic boron nitride, aluminum oxide, zircon, silicon, whisker reinforced ceramics, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, thermally stable diamond, or combinations thereof. The hard material 305 may be flat, domed, semi-domes, conical, frusto-conical, or combinations thereof. The intermediate material 601 may comprise tungsten carbide, tungsten, tantalum, titanium, molybdenum, carbide, matrix, silicon, TiN, AlNi, AlTiNi, TiAlN, CrN/CrC/(Mo, W)S2, TiN/TiCN, AlTiN/MoS2, TiAlN, ZrN, or combinations thereof. If produced in segment form, the intermediate material 601 may comprise a diameter of 0.3 to 1.3 inches. The hard metal 305 may be bonded to the intermediate material 601 at an interface 605. The interface 605 may be planar or non-planar. Typically, such segments are formed in a high temperature high pressure press. In the preferred embodiment, diamond particles are placed adjacent a tungsten carbide substrate in a can which is subjected to high temperature and high pressure. During this process, the particles form a polycrystalline diamond table bonded to the substrate. The substrate may then be bonded to the penetrator at the distal end or at other locations which may be subjected to wear.

Figure 18:
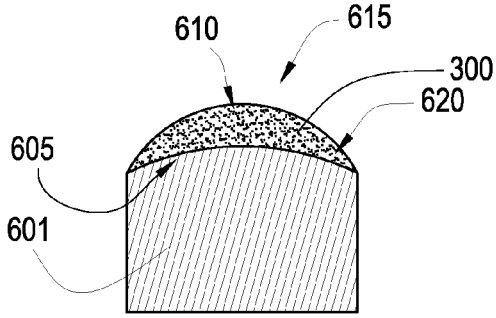
FIG. 18 is a cross-sectional diagram of another embodiment of a hard material bonded to an intermediate material.
Figure 19:
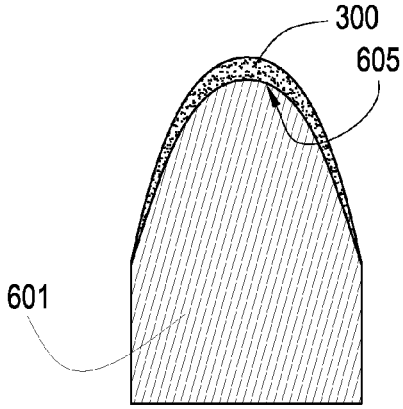
FIG. 19 is a cross-sectional diagram of another embodiment of a hard material bonded to an intermediate material.
Figure 20:
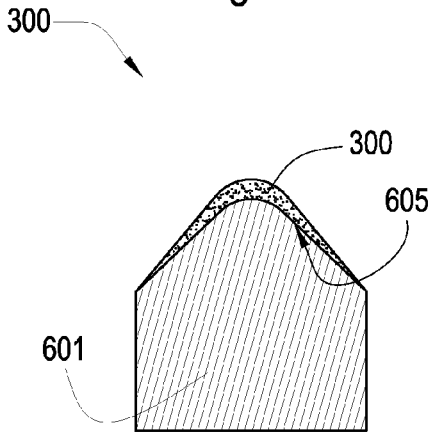
FIG. 20 is a cross-sectional diagram of another embodiment of a hard material bonded to an intermediate material.
Figure 21:
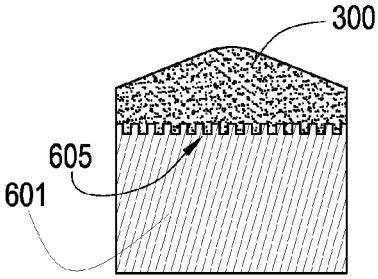
FIG. 21 is a cross-sectional diagram of another embodiment of a hard material bonded to an intermediate material.
Figure 22:
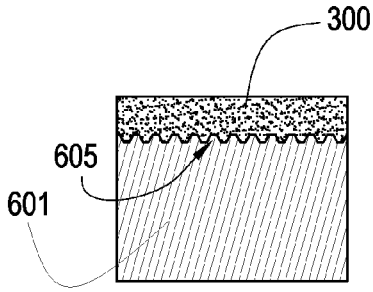
FIG. 22 is a cross-sectional diagram of another embodiment of a hard material bonded to an intermediate material.

The hard material 300 may be a ceramic comprising a binder. The binder may comprise cobalt, iron, nickel, ruthenium, rhodium, palladium, chromium, manganese, tantalum, silicon, niobium, tungsten, or combinations thereof. The hard material 305 may comprise a region 610 proximate the surface with a lower binder concentration than a region 620 proximate the interface 605 as shown in FIG. 18. The region 610 proximate the surface 615 may be free of binder as well. The hard material and/or the intermediate material may comprise a binder concentration of 1 to 35 weight percent. The preferred binder is cobalt.

Figure 23:
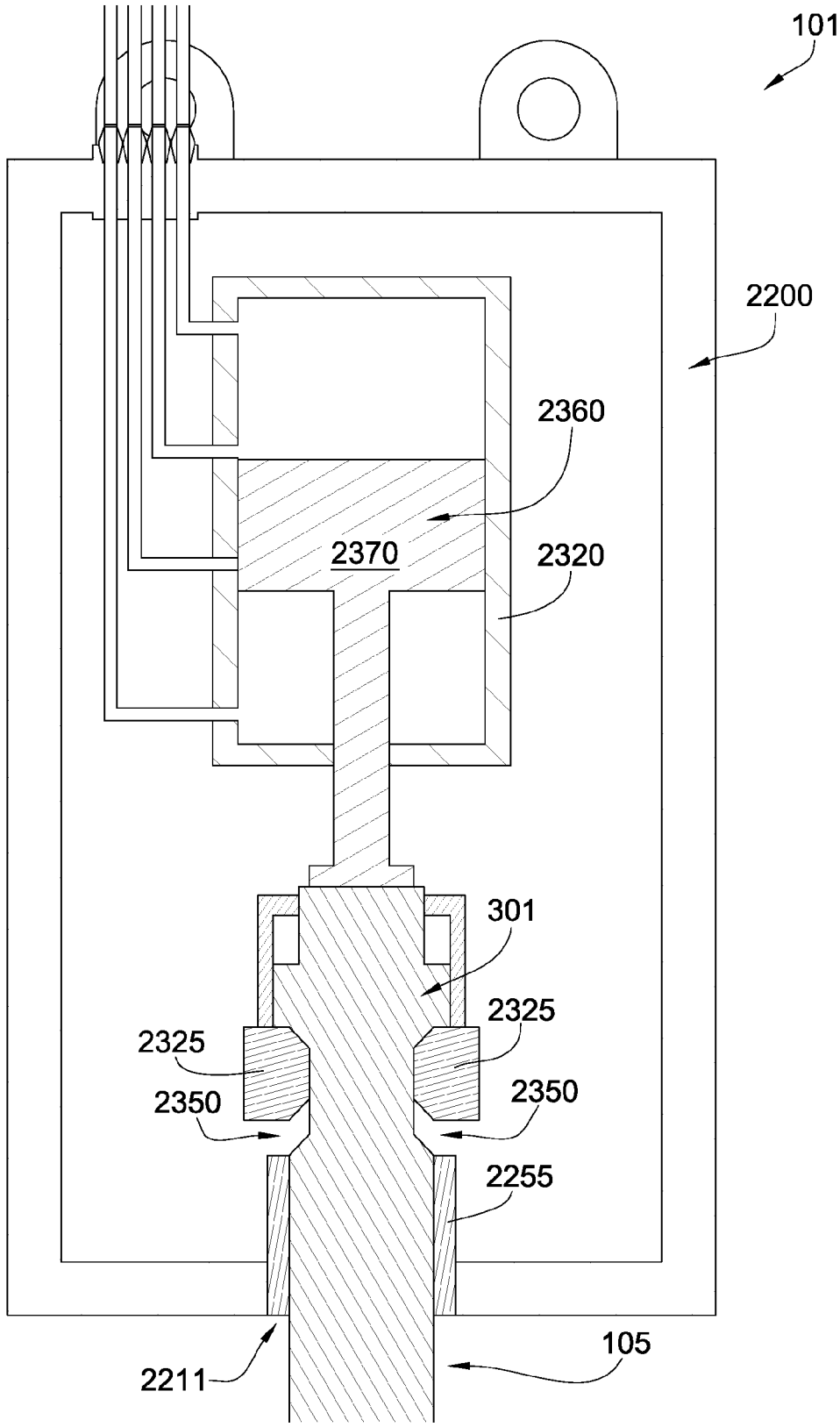
FIG. 23 is a cross-sectional diagram of an embodiment of an actuator.

FIG. 23 is a cross-sectional diagram of embodiment of an actuator 2300 for a breaker assembly 101. The actuator 2300 may comprise a hydraulic chamber 2320 with a piston mechanically in communication with a proximate end 301 of the penetrator 105. The assembly 101 may include a housing around the actuator. The penetrator 105 may be extend through an opening 2211 in the housing. A bushing 2255 adjacent the opening may comprising a hard material 300. The penetrator 105 may be secured within the housing 2200 and axially guided by means of retaining pins 2325 that fit within indentations 2350 in the proximate end 301. The pins 2325 may not fill the indentations 2350 so that axial movement may be allowed. The proximate end 301 of the penetrator may abut an end of the piston 2360 located within a hydraulic chamber 2320. The assembly 101 may further comprise hydraulic lines 2305, 2310 that feed fluid into and out of the hydraulic chamber 2320. A hydraulic controller 2315 may enable axial movement of the penetrator by controlling the flow of the fluid to above and below the piston head 2370.

Figure 24:
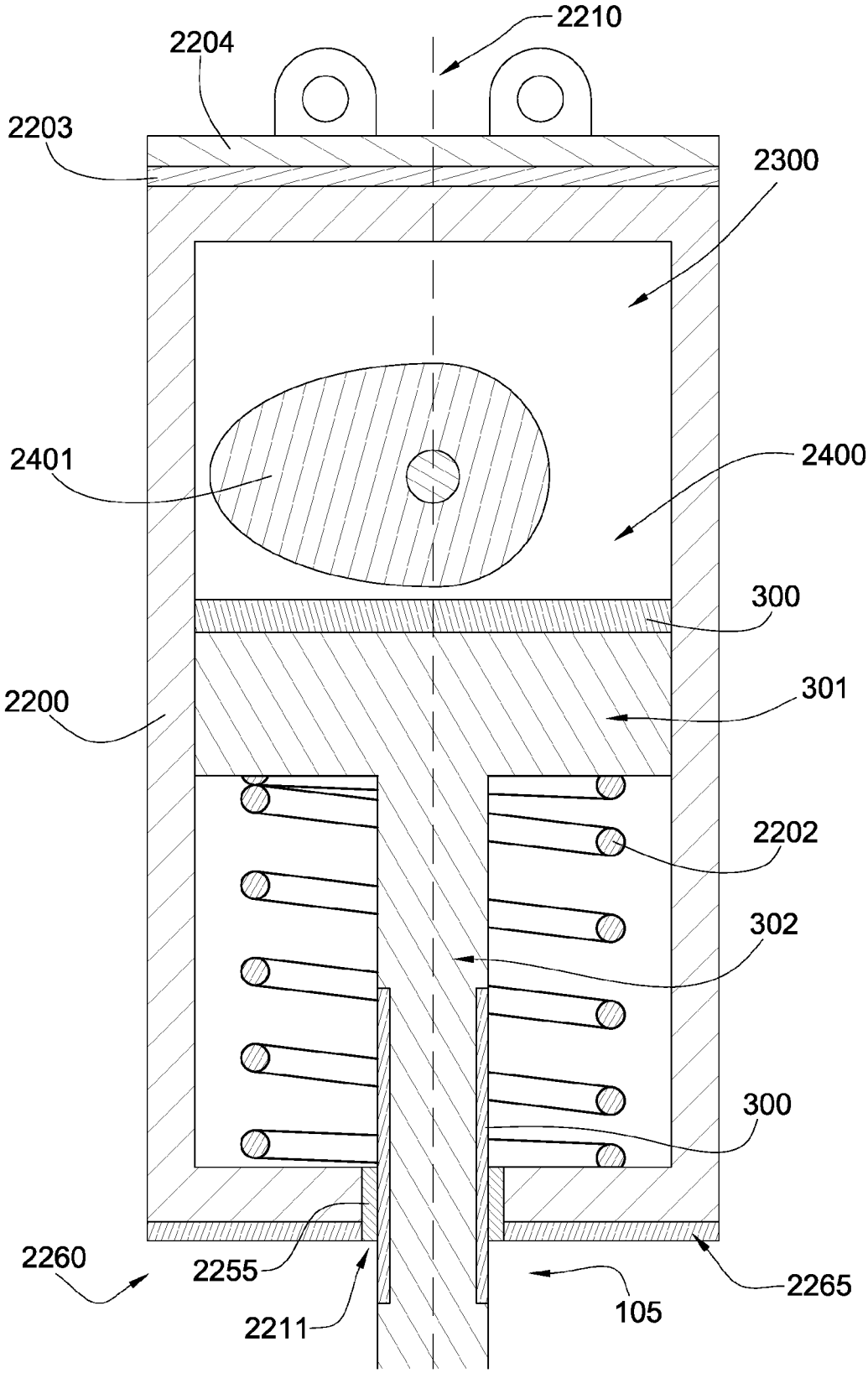
FIG. 24 is a cross-sectional diagram of another embodiment of an actuator.

FIG. 24 is a cross-sectional diagram of an embodiment of an actuator 2300. The proximate end 301 may comprise a head 2400 which interacts with a cam 2401. The penetrator 105 may also be secured within the housing 2200 through other means, such as a bolt (not shown), as long as a portion of the penetrator 105 can move axially through the opening 2211. An actuator 2300 may comprise a hydraulic ram, a piston, a cam 2401, a rotor, a smart material, or combinations thereof. The actuator 2300 may be coaxial with the penetrator 105 and may apply axial force to the head 2400 such that the penetrator 105 moves along a central axis 2210 of the breaker. A spring 2202 may be located within the housing 2200 proximate the penetrator 105 and the spring 2202 may abut the head. The spring 2202 may provide counter force to the actuator 2300 to enable rectilinear movement of the penetrator 105 along the axis 2210.

The assembly 101 may further comprise a plate 2204 that is adapted to connect the assembly 101 to the articulated arm. An elastomeric material 2203 may be disposed between arm and the actuator 2300, penetrator 105, and/or housing 2200. This may reduce vibration and recoil coming from the assembly 101 when in operation.

The housing 2200 and penetrator 105 may also comprise other features comprising hard material adapted to reduce wear. Concerning the penetrator 105, the head and/or proximate end may comprise a hard material 305 with a hardness greater than or equal to 63 HRc. The hard material 305 may cover entire surface of the proximate end 301 or it may be layered or segmented. The hard material 305 may also be bonded to the body 302 or anywhere else on the penetrator 105. Hard material may be disposed along a portion or the entire length of the body 302. The opening 2211 itself may comprise a bushing 2255 that may be fixed to the housing 2200 and is adapted to align or guide at least a portion of the penetrator 105. The bushing 2255 may comprise the hard material 300. Additionally, at least a portion of the housing 2200 may comprise a hard material 305 with a hardness of at least 63 HRc. A bottom portion 2260 of the housing may comprise a plate made entirely of the hard material 300, or it may comprise a layer 2265 of the hard material 300. Having the hard material 300 on the bottom portion 2260 may increase wear-resistance by protecting the housing 2200 from debris and dust that can wear down the housing 2200.

What is claimed is:

1. A formation breaking apparatus, comprising:

an assembly attached to an end of an articulated arm;

the assembly comprising an actuator in mechanical communication with an axially guided penetrator;

the penetrator comprising a body intermediate a proximate end and a distal end;

the proximate end being adapted to communicate with the actuator; and the distal end comprising a hard material with a hardness of at least 63 HRc;

the actuator is disposed within a housing and a portion of the axially guided penetrator extends out of an opening in the housing;

a bushing is fixed to the housing and is adapted to align at least a portion of the penetrator; and the bushing comprises a hard material with a hardness of at least 63 HRc.

2. The apparatus of claim 1, wherein the actuator comprises a hydraulic ram, a piston, a cam, a rotor, a smart material, or combinations thereof.

3. The apparatus of claim 1, wherein the hard material is comprises chromium, tungsten, tantalum, niobium, titanium, molybdenum, carbide, natural diamond, polycrystalline diamond, vapor deposited diamond, layered diamond, infiltrated diamond, cubic boron nitride, aluminum oxide, zircon, silicon, whisker reinforced ceramics, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, thermally stable diamond, or combinations thereof.

4. The apparatus of claim 3, wherein the hard material comprises a binder.

5. The apparatus of claim 4, wherein the binder comprises comprise cobalt, iron, nickel, ruthenium, rhodium, palladium, chromium, manganese, tantalum, niobium, tungsten, or combinations thereof.

6. The apparatus of claim 1, wherein the distal end comprises a moil geometry, a chisel geometry, a conical geometry, a rounded geometry, a flat geometry, a pyramidal geometry, an asymmetric geometry, semi-spherical geometry, or combinations thereof.

7. The apparatus of claim 1, wherein at least a portion of the housing comprises a hard material with a hardness of at least 63 HRc.

8. The apparatus of claim 1, wherein the hard material is bonded to an intermediate material.

9. The apparatus of claim 8, wherein the hard material and/or intermediate material is chemically and/or mechanically bonded to the distal end at an interface.

10. The apparatus of claim 1, wherein the penetrator is solid.

11. The apparatus of claim 1, wherein the distal end is tapered.

12. The apparatus of claim 1, wherein the hard material is also attached to the body of the penetrator.

13. The apparatus of claim 1, wherein the arm is attached to a movable vehicle.

14. The apparatus of claim 1, wherein the penerator comprises a diameter of 1 to 15 inches.

15. The apparatus of claim 1, wherein the hard material has a hardness of at least 4,000 HV.

16. The apparatus of claim 1, wherein the proximate end comprises a hard material with a hardness greater than or equal to 63 HRc.

17. The apparatus of claim 1, wherein the hard material is a composite.

* * * * *